US005544505A

United States Patent [19]

McIntosh et al.

[11] Patent Number: 5,544,505

[45] Date of Patent: Aug. 13, 1996

[54] LOCK BRACKET

[75] Inventors: John D. McIntosh, 9 Applegum Grove, East Doncaster, Victoria 3109; Paul J. Clark, Kangaroo Ground, both of Australia

[73] Assignee: John Dalwyn McIntosh, Victoria, Australia

[21] Appl. No.: 325,389

[22] PCT Filed: Apr. 28, 1993

[86] PCT No.: PCT/AU93/00179

§ 371 Date: Nov. 28, 1994

§ 102(e) Date: Nov. 28, 1994

[87] PCT Pub. No.: WO93/22534

PCT Pub. Date: Nov. 11, 1993

[30] Foreign Application Priority Data

Apr. 28, 1992 [AU] Australia ..... PL2098

[51] Int. Cl.[6] ..... E05B 73/00; E05B 67/38

[52] U.S. Cl. ..... 70/18; 70/14; 70/54

[58] Field of Search ..... 70/19, 18, 14, 70/54, 55, 56; 403/385, 396, 399; 292/205, 148, 44, 45, 54, DIG. 21, DIG. 13

[56] References Cited

U.S. PATENT DOCUMENTS

| | | | |
|---|---|---|---|
| 577,673 | 2/1897 | Wickliffe . | |
| 1,218,013 | 3/1917 | Sturr | 70/18 |
| 1,329,784 | 2/1920 | Lundin . | |
| 2,856,220 | 10/1958 | Easley | 292/148 |
| 2,963,895 | 12/1960 | Thomas | 70/18 |
| 3,570,283 | 3/1971 | Males | 70/14 |
| 3,926,018 | 12/1975 | Joersz | 70/19 |
| 4,216,665 | 8/1980 | McKelvey | 70/58 |
| 4,380,160 | 4/1983 | Hoffman | 70/14 |
| 4,803,857 | 2/1989 | Hall et al. | 70/14 |
| 4,877,275 | 10/1989 | DeForrest, Sr. | 292/148 |
| 4,896,518 | 1/1990 | Appelgren | 70/14 |
| 4,955,215 | 9/1990 | Ermita | 70/18 |
| 5,076,077 | 12/1991 | Renne | 70/14 |

FOREIGN PATENT DOCUMENTS

| | | | |
|---|---|---|---|
| 2443946 | 8/1980 | France | 70/203 |
| 2927762 | 1/1981 | Germany . | |
| 228804 | 12/1943 | Switzerland . | |
| 8301646 | 5/1983 | WIPO | 70/233 |

*Primary Examiner*—Steven N. Meyers
*Assistant Examiner*—Tllyet-Phllong Pham
*Attorney, Agent, or Firm*—Oliff & Berridge

[57] ABSTRACT

A lock bracket comprises two bracket members which cooperate to define an area between them to secure together two adjacent objects. The bracket members are movable relative to each other between an open orientation, in which the lock bracket can be placed around or removed from the two adjacent objects and a closed orientation in which the two adjacent objects can be held securely in the area defined between the two bracket members. Each of the two bracket members has a padlock receiving area and the two padlock receiving areas cooperate when the lock bracket is in its closed orientation.

15 Claims, 2 Drawing Sheets

LOCK BRACKET

This invention relates to a lock bracket. It relates particularly to a substantially tamper-proof bracket for securing together two adjacent objects such as a gate and a fence post. The invention will be described with particular reference to the application of securing gates against intruders, but it is to be understood that the invention has many other applications such as securing bicycles to bicycle racks or securing objects to motor vehicle roof racks or other fixtures.

The problem of securing premises against intruders has been around for some time. When premises are surrounded by fences, a gate often provides a weak spot for intruders to attack.

Double gates are conventionally secured by means of a chain passed around the end of each gate when the gates are closed, and the chain is held in place by a padlock. A single gate is conventionally secured by means of a chain passing around the end of the gate and an adjacent fence post when the gate is shut, with the chain being secured by a padlock.

Chain-secured gate arrangements are vulnerable to attack by bolt cutters, saws, files, chisels and other such devices. It is possible to make chains out of a harder form of steel which resists breaking, but such chains are still unlikely to be effective against determined intruders. Furthermore, padlocks themselves are vulnerable to attack by means of bolt cutters, saws and other similar devices. It is common for the shackles of padlocks to be made of hardened steel but such shackles are still insufficient to deter determined intruders.

According to one aspect of the present invention there is provided a lock bracket for securing together two adjacent objects, comprising two bracket members which cooperate to define between them an area into which the two adjacent objects fit, the bracket members being movable relative to each other between an open orientation, in which the lock bracket can be placed around or removed from the two adjacent objects, and a closed orientation in which the two adjacent objects can be held securely in the area defined between the two bracket members, wherein each of the two bracket members has a padlock receiving means, and the two padlock receiving means cooperate when the lock bracket is in its closed orientation, allowing a padlock to lock the bracket members together.

Because the bracket members can be considerably more substantial than the links in a normal chain, the bracket members can provide a greater amount of resistance to intruders than is provided by a conventional chain. It is preferred that the degree of resistance to intruders be increased by manufacturing the two bracket members from a hardened material, with hardened steel being especially preferred. Where the lock bracket is made from steel, it is further preferred that the whole lock bracket be hardened after it has been constructed. This can be effected by means of carbon impregnation, according to known techniques.

In some embodiments of the present invention, the two bracket members may be connected together by means of a hinge. The hinge may be more vulnerable to an attack by an intruder than is the rest of the lock bracket, because the connections between elements of the hinge and their respective bracket members may provide a smaller quantity of material through which an attacker must cut than that provided by the rest of the lock bracket. In order to inhibit attacks on the hinge, it is preferred that the hinge be offset to one side of the lock bracket, such that the hinge presses against or almost presses against one of the two adjacent objects when the lock bracket is installed. It is much more difficult for an intruder to manoeuvre a saw or file to cut through the hinge or a hinge weld if the hinge is pressing up against an object than if the hinge is positioned away from the objects such that an intruder is given plenty of room to manoeuvre a saw or file.

In order to reduce the risk of attack on a padlock used in connection with the lock bracket, it is preferred that one or more padlock shielding members be provided either as part of one or both of the bracket members or attached to one or both of the bracket members near the padlock receiving means. It is especially preferred that, where the padlock receiving means is configured such that a padlock is received in a shackle up orientation, padlock shielding members be provided close to each side of the padlock and above the top of the shackle.

According to another aspect of the invention, there is provided a lock bracket for securing together two objects, comprising a centre member, two bracket members movably attached to the centre member on opposite sides thereof, each bracket member cooperating with the centre member to define an area in which one of the two objects may be located, each bracket member being movable independently between an open orientation in which the corresponding object can be moved towards or away from the bracket member and a closed orientation in which the object can be locked securely in the area defined between the bracket member and the centre member, wherein each bracket member has padlock receiving means and the centre member has padlock receiving means such that the respective bracket members may be locked independently to the centre member by separate padlocks.

The invention will hereinafter be described in greater detail by reference to the attached drawings which show an example form of the invention. It is to be understood that the particularity of those drawings does not supersede the generality of the preceding description of the invention.

Figure 2:
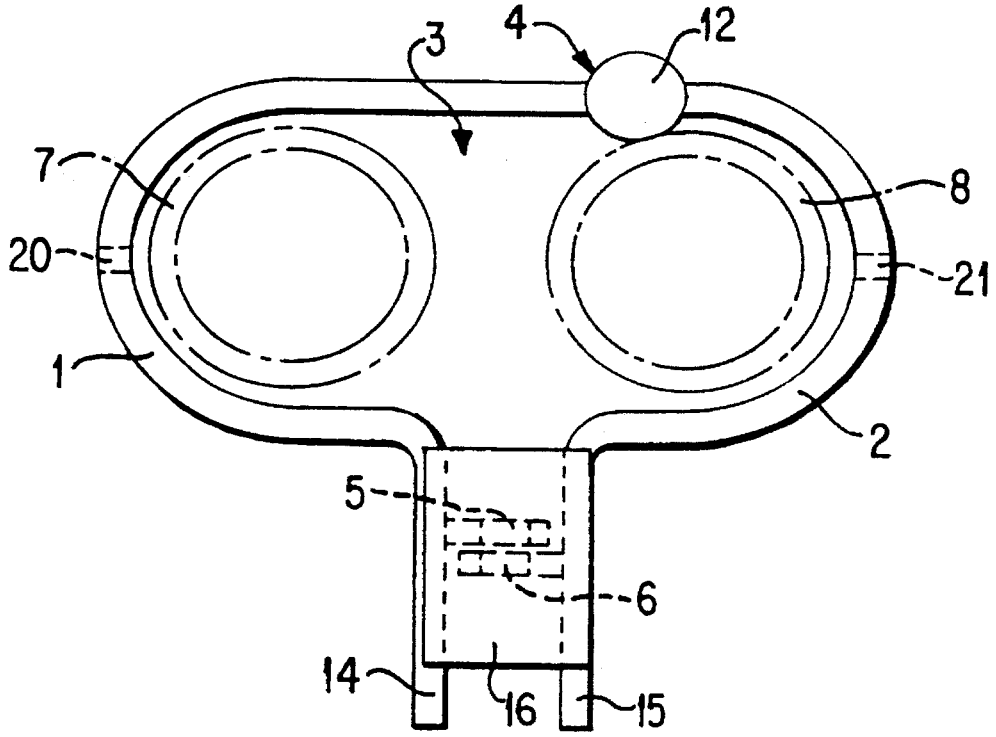
FIG. 2 is a top plan view of the lock bracket of FIG. 1.

The lock bracket of the present invention is for use in securing together two adjacent objects, such as posts (shown as 7 and 8 in FIG. 2). The lock bracket comprises two bracket members 1 and 2 which cooperate to define between them an area 3 into which the two adjacent objects fit. Bracket members 1 and 2 are moveable relative to each other between an open orientation, in which the lock bracket can be placed around the two adjacent objects, and a closed orientation (shown in FIG. 2) in which the two adjacent posts can be held securely in the area 3 defined between bracket members 1 and 2. Bracket members 1 and 2 have padlock receiving means 5 and 6 respectively, and these cooperate when the lock bracket is in its closed orientation, allowing a padlock to lock the bracket members together.

Bracket members 1 and 2 may be of any suitable shape and material. Suitable materials include various strong plastics and metals, with hardened materials and especially hardened steel being most preferred. In the embodiment illustrated, bracket members 1 and 2 are made from lengths of steel bent into an appropriate configuration. The other elements of the lock bracket are then welded onto bracket members 1 and 2, and the entire unit undergoes hardening by means of carbon impregnation according to known techniques. Bracket members 1 and 2 may include one or more optional fastening holes 20,21 to allow for attachment to a gate or other object.

Figure 1:
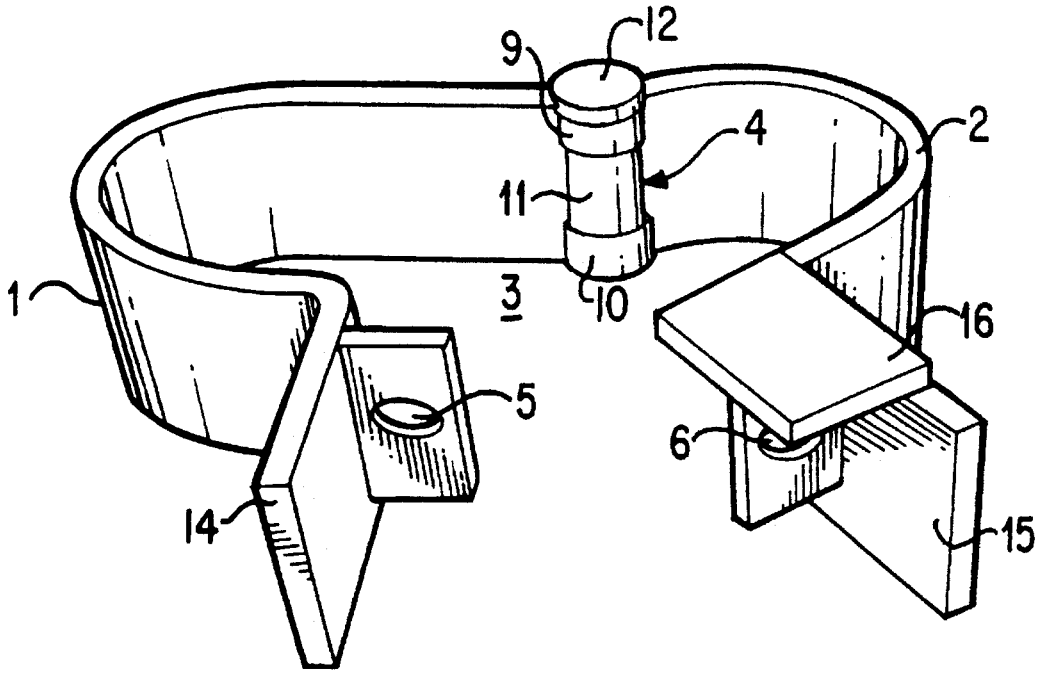
FIG. 1 is a perspective view of an embodiment of a lock bracket according to the present invention, with the lock bracket being partly open.

In the embodiment illustrated in FIG. 1, bracket members 1 and 2 are connected together by means of hinge 4.

Hinge 4 may be of any suitable materials and configuration. The embodiment illustrated shows an especially preferred configuration in which hinge 4 comprises top cylinder 9, bottom cylinder 10, central cylinder 11 and cap 12. Each of the top cylinder 9 and bottom cylinder 10 has a central bore, which enables it to be placed over a pin (not shown). Top and bottom pins are fixed to central cylinder 11. Top and bottom cylinders 9 and 10 can rotate freely relative to central cylinder 11. Top and bottom cylinders 9 and 10 are joined by welding or other suitable means to one of bracket members 1 and 2, and central cylinder 11 is joined to the other bracket member. Cap 12 is preferably welded to the top of cylinder 9 in order to make it more difficult to cut through hinge 4.

Because of the joins between hinge elements 9, 10 and 11, and their respective bracket members 2 and 1, it is anticipated that hinge 4 may be more vulnerable to attack by an intruder than the rest of the lock bracket. In order to compensate for this, hinge 4 is offset to one side of the lock bracket so that, when it is installed onto adjacent objects, as shown in FIG. 2, it presses against one of the objects 8. This makes it very difficult for an intruder to manipulate a saw or file to break through hinge 4. If, on the other hand, hinge 4 were located at a central point, an intruder would be able to run a saw or file between adjacent objects 7 and 8 so that breaking through hinge 4 would be relatively easy.

Padlock receiving means 5 and 6 may be of any suitable shape and configuration. It is preferred that each of padlock receiving means 5 and 6 comprises an attachment to or a part of the corresponding bracket member, with a hole suitable for receiving the shackle of a padlock. It is preferred that padlock receiving means 5 and 6 cooperate in such a way that, when the lock bracket is in its closed orientation, the holes in padlock receiving means 5 and 6 are in alignment, permitting a padlock to be inserted and closed, locking the lock bracket into the closed position.

In the embodiments illustrated, padlock receiving means 5 comprises a lug welded to bracket member 1, and padlock receiving means 6 comprises a lug welded to bracket member 2.

It is preferred that padlock shielding members be provided surrounding padlock receiving means 5 and 6, to hinder an attack by an intruder on a padlock received in the receiving means. A single wall 14 or 15 located close to the padlock can hinder an attack by an intruder by means of a saw or file, but it is preferred that walls 14 and 15 be provided on both sides of lock receiving means 5 and 6 so that attack is prevented from both sides. It is preferred that top wall 16 also be provided, to prevent attack from above. In the embodiment illustrated, walls 14, 15 and 16 define a narrow area in which a padlock can reside, with its shackle facing upwards. The walls in conjunction with the narrowness of the area defined between them prevent an attack on the shackle. It is preferred that top wall 16 extend a small distance over side wall 14 when the lock bracket is in its closed orientation, to avoid exposing the lock shackle in the event that a narrow shackle width relative to the size of lock receiving holes 5 and 6 allows movement of the bracket members when locked together.

According to a further preferred feature, side walls 14 and 15 extend downwards below the bottom of padlock receiving means 5 and 6, as shown in FIG. 1. The upper part of the pad of a padlock as well as the entire shackle can thus be protected between walls 14 and 15, ensuring that the shackle cannot be reached by bolt-cutters or similar tools. Walls 14, 15 and 16 may be made from any suitable material. They may be an integral part of bracket members 1 and 2, or they may be separate pieces attached to bracket members 1 and 2. In the embodiments illustrated, protective walls 14 and 15 are integral with bracket members 1 and 2, and top wall 16 is welded to protective side wall 15.

Figure 3:
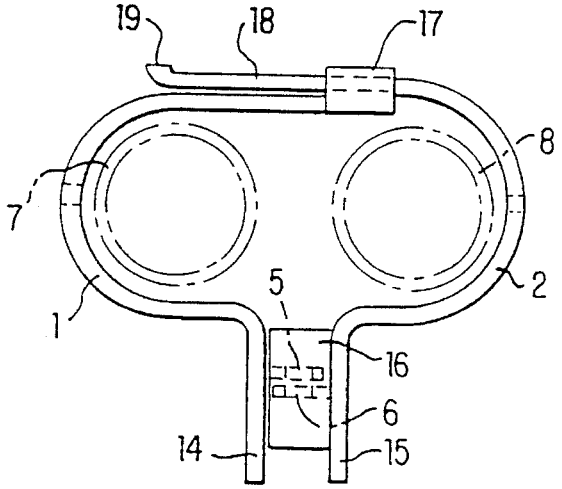
FIG. 3 is a top plan view of an alternative embodiment of a lock bracket according to the invention.

In the embodiment shown in FIG. 3, hinge 4 has been replaced by a sliding connection comprising a housing 17 welded to bracket member and an extended end 18 on bracket member 2 sliding freely within housing 17. Stopper 19 prevents end 18 from sliding completely through housing 17. As end 18 slides back and forth through housing 17, the lock bracket moves between open and closed orientations.

Figure 4:
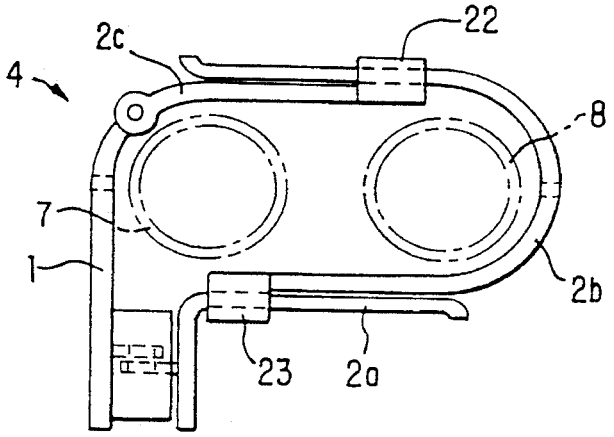
FIG. 4 is a top plan view of another alternative embodiment.

FIG. 4 shows a modified sliding system in which bracket member 2 comprises lock receiving portion **2*a*, sliding portion 2*b*, and hinge portion 2*c*. Sliding portion 2*b* moves away from or towards bracket member 1, thereby effecting an adjustment of the bracket size and allowing the bracket to accommodate objects of different sizes and configurations. After adjustment, sliding portion 2*b* may be clamped into place relative to the rest of bracket member 2 by clamping means (not shown) such as screws or pins. The lock bracket may be opened by sliding at slide housing 23 and/or slide housing 22 and/or by hinging at hinge 4**.

Figure 5:
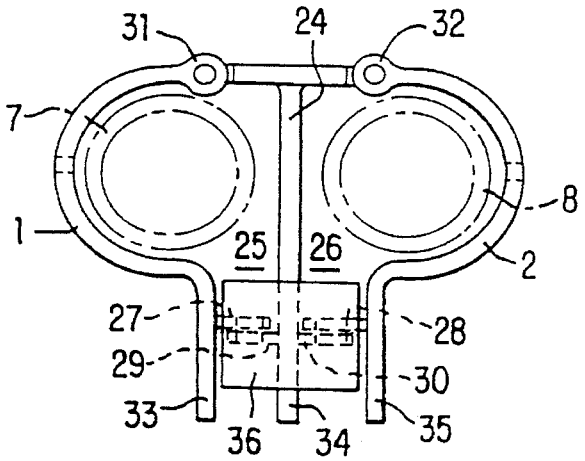
FIG. 5 is a top plan view of a further alternative embodiment.

FIG. 5 shows a dual locking embodiment. This embodiment accommodates two locks and is suitable for situations in which access to a premises is required by unlocking either one or the other of the locks.

The lock bracket comprises centre member 24. Two bracket members 1,2 are movably attached to centre member 24, on opposite sides. Bracket members 1 and 2 cooperate with centre member 24 to define areas 25 and 26 in which objects 7 and 8 may be located. Each bracket member (1 or 2) is movable independently between an open orientation in which the corresponding object (7 or 8) is "free" and a closed orientation (as illustrated) in which the object can be locked securely in the area (25 or 26) defined between the bracket member (1 or 2) and centre member 24.

Each bracket member (1,2) has padlock receiving means (27,28), and centre member 24 has padlock receiving means (29,30) such that the respective bracket members may be locked independently to the centre member by separate padlocks.

In the embodiment illustrated in FIG. 5, bracket members (1,2) are connected to centre member 24 by means of two hinges (31,32). The hinges are positioned such that, when each bracket member is closed around one of the two objects, each hinge abuts one of the objects. In an alternative arrangement (not shown), sliding connections may be used in place of hinges.

The shackles of padlocks received in padlock receiving means (27,29) and (28,30) are shielded by side walls 33,34, 35 and by top wall 36.

It will be seen that the invention in its preferred forms provides a lock bracket which has a very considerable resistance to tampering.

It is to be understood that various alterations, additions and/or modifications may be made to the parts previously described without departing from the ambit of the present invention.

We claim:

1. A lock bracket for securing together two adjacent objects, the lock bracket comprising:

two bracket members movable relative to each other between a closed orientation, wherein said bracket members cooperate to define an enclosed area adapted to receive the two adjacent objects, and an open orientation, wherein a gap is formed between said bracket members that enables said lock bracket to be placed around or removed from the two adjacent objects;

each said bracket member comprising a padlock receiving device, each said padlock receiving device being cooperable when said lock bracket is in its closed orientation to form a passage that extends through each said padlock receiving device, said passage having openings at opposing ends and being adapted to receive a shackle of a padlock through said openings for locking said bracket members together in the closed orientation; and each said bracket member comprising a padlock shielding member, said padlock shielding members being located on opposing sides of said passage and being cooperable to protect the shackle of the padlock when the shackle is inserted through said passage.

2. A lock bracket according to claim 1, wherein each shielding member includes a wall surface, and wherein when the lock bracket is in its closed orientation, the wall surfaces face each other on respective sides of the passage and extend generally along said passage beyond the openings therein.

3. A lock bracket according to claim 2, wherein the padlock receiving devices extend outwardly from respective ones of the wall surfaces.

4. A lock bracket according to claim 2, wherein at least one of the shielding members further comprises a second wall surface that extends between the wall surfaces when the lock bracket is in its closed orientation.

5. A lock bracket according to claim 1, wherein each padlock receiving device comprises a lug incorporating an aperture therein, each of the apertures being adapted to align when the lock bracket is in its closed orientation to form the passage.

6. A lock bracket according to claim 1, wherein the two bracket members are connected together by a hinge that is offset to one side of the lock bracket.

7. A lock bracket according to claim 1, wherein the two bracket members are connected together by a sliding connection.

8. A lock bracket for securing together two objects, the lock bracket comprising:

a center member;

two bracket members movably attached to the center member on opposing sides thereof;

padlock receiving devices located on the center member and each of the bracket members; and a padlock shielding member located on each of the bracket members;

wherein each one of the bracket members is movable independently of the other bracket member between a closed orientation, when one of the bracket members cooperates with the center member to define an enclosed area that is adapted to receive one of the objects, and an open orientation, wherein a gap is formed between the one bracket member and the center member for enabling the lock bracket to be placed around or removed from the object, and wherein when either one of the bracket members is in a closed orientation, a first passage is formed through the padlock receiving device of the center member and the one bracket member, the first passage having openings at opposing ends thereof and being adapted to receive a shackle of a padlock through the openings to enable the one bracket member to be locked to the center member by a padlock independently of another bracket member, wherein the shielding member of the one bracket member is arranged to be located on one side of the first passage, with the center member located on the other side of the first passage, so as to protect the shackle of the padlock when inserted through the first passage.

9. A lock bracket according to claim 8, wherein the first passage formed when the one bracket member is in its closed orientation is arranged to be substantially parallel to a second passage formed when the other bracket member is in its closed orientation, and wherein the center member comprises a first part adapted to extend between said first and second passages beyond their respective openings, the first part of the center member having one surface facing the first passage and an opposing surface facing the second passage.

10. A lock bracket according to claim 9, wherein the shielding member on said one side of said first passage includes a wall surface that faces the one surface of the center member, and the shielding member on said one side of said second passage includes a wall surface that faces the opposing surface of the center member, wherein the wall surfaces of the shielding members extend substantially in the direction of the first and second passages beyond their respective openings.

11. A lock bracket according to claim 10, wherein the padlock receiving device of each of the bracket members extends outwardly from a respective one of said wall surfaces.

12. A lock bracket according top claim 9, wherein the center member includes two padlock receiving devices, one extending outwardly from said one surface and the other extending outwardly from said opposing surface.

13. A lock bracket according to claim 9, wherein the center member includes a second part that extends transverse to said first part, said second part having opposing ends to which respective ones of the bracket members are movably attached through a hinge connection.

14. A lock bracket according to claim 8, wherein the center member includes a pair of said padlock receiving devices, each of the padlock receiving devices of the center member and the bracket members comprising a lug incorporating an aperture therein, and wherein the passages are formed on movement of the bracket members to their closed orientations by the apertures of the bracket member lugs aligning with respective ones of the lugs of the center member.

15. A lock bracket according to claim 8, wherein the center member further comprises a padlock shielding member arranged to extend between the center member and the shielding members of the bracket members when in their closed orientation.

* * * * *